US009370265B2

(12) United States Patent
Whittington et al.

(10) Patent No.: US 9,370,265 B2
(45) Date of Patent: Jun. 21, 2016

(54) FOLDABLE MOBILE RESTAURANT BOOTH

(71) Applicant: Palmer Hamilton, LLC, Elkhorn, WI (US)

(72) Inventors: Steve M. Whittington, Roscoe, IL (US); Jeffrey Allen Schreiner, Wind Lake, WI (US)

(73) Assignee: Palmer Hamilton, LLC, Elkhorn, WI (US)

( * ) Notice: Subject to any disclaimer, the term of this patent is extended or adjusted under 35 U.S.C. 154(b) by 183 days.

(21) Appl. No.: 13/940,564

(22) Filed: Jul. 12, 2013

(65) Prior Publication Data

US 2015/0015034 A1 Jan. 15, 2015

(51) Int. Cl.

| | |
|---|---|
| ***A47F 10/06*** | (2006.01) |
| ***A47B 83/02*** | (2006.01) |
| ***A47C 7/56*** | (2006.01) |

(52) U.S. Cl.

CPC ..... *A47F 10/06* (2013.01); *A47B 83/02* (2013.01); *A47C 7/56* (2013.01); *A47B 2200/0071* (2013.01)

(58) Field of Classification Search

CPC ..... A47B 83/02; A47C 7/56; A47F 10/06

USPC ..... 297/331, 332, 334, 335, 129, 158.1, 297/158.2

See application file for complete search history.

(56) References Cited

U.S. PATENT DOCUMENTS

| | | | | |
|---|---|---|---|---|
| 2,383,837 | A | 8/1945 | Ashmusen | |
| 2,409,805 | A * | 10/1946 | Shikles | 297/158.2 X |
| 2,673,594 | A * | 3/1954 | Tullinen | 297/321 X |
| 3,028,197 | A | 4/1962 | Wilson | |
| 3,061,369 | A | 10/1962 | Haunost | |
| 3,171,685 | A * | 3/1965 | Hershberger et al. | 297/158.2 |
| 3,536,356 | A * | 10/1970 | Wilson | 297/331 |
| 3,706,471 | A * | 12/1972 | Shimosawa | A47B 83/02 297/158.1 X |
| 4,606,575 | A | 8/1986 | Kodet | |
| 5,641,202 | A | 6/1997 | Rus | |
| 6,929,321 | B1 * | 8/2005 | Shrock | 297/158.1 |
| 7,040,702 | B2 | 5/2006 | Yamada et al. | |
| 7,226,125 | B2 | 6/2007 | Frobose et al. | |
| 7,494,182 | B2 * | 2/2009 | Westendorf et al. | 297/284.2 X |
| 7,658,447 | B2 | 2/2010 | Soditch et al. | |
| 8,152,240 | B2 | 4/2012 | Yamada et al. | |
| 8,182,032 | B2 | 5/2012 | Dickey et al. | |

FOREIGN PATENT DOCUMENTS

| | | | | |
|---|---|---|---|---|
| DE | 19635154 C1 * | 5/1997 | ..... | A47B 83/02 |

* cited by examiner

*Primary Examiner* — Anthony D Barfield

(74) *Attorney, Agent, or Firm* — Boyle Fredrickson S.C.

(57) ABSTRACT

A foldable mobile restaurant booth and a method of its use are configured for ease of mobility and storage by allowing the seat portion to fold upward toward the seat back. The booth has a seat back and seat portion coupled to a base, and a linkage arrangement coupling the seat portion to the seat back. The base may have a plurality of wheels for allowing the booth to roll easily on the ground. The linkage arrangement permits the seat portion to move between a first, operative position to a second, folded position in which the seat portion extends at an angle no more than 45 degrees from vertical.

18 Claims, 8 Drawing Sheets

FOLDABLE MOBILE RESTAURANT BOOTH

BACKGROUND OF THE INVENTION

1. Field of the Invention

The invention relates generally to booth seating, and more particularly, relates to restaurant/cafeteria booth seating having an upwardly collapsible seat portion having a linkage system to facilitate movement of the seat toward the back rest. The invention additionally relates to a method of using such an apparatus.

2. Discussion of the Related Art

Booth seating is a common and frequently used furniture option for public eating places and private kitchens alike. Public eating places historically have provided patrons with a wide variety of seating options; however, the restaurant booth has provided a certain amount of privacy and intimacy with members of one's dining party that patrons have continued to enjoy over the years. Moreover, booths can be a space saver for restaurant owners and can be custom-built to provide seating in a number of different configurations. These advantages have transcended commercial venues and have made booth seating a desirable option for private kitchens as well.

The typical booth seating construction found in public eating places includes a plastic laminated frame with foam padding on the seat portion and back rest. The foam padding is typically covered by fabric or vinyl, and the booth typically has a solid base that sits upon the ground. However, other variations of booth construction and styles are known in the art.

One of the drawbacks of booth seating is that they are cumbersome compared to tables and chairs. Booths are generally heavy and large, and thus, difficult to maneuver. Another disadvantage is that booths are more difficult to maintain than tables and chairs. The crevices of a booth are often difficult to access and the immobility makes it difficult to reach all sides of the booth. Moreover, if the fabric or vinyl tears or stains, the covering or even entire booth needs to be replaced which can be very expensive. Lastly, booths are difficult to store given their large size and awkward construction. Storage may be necessary, for example, for routine cleaning and maintenance of floors. Storage is also desirable if the booths are used in a so-called "multi-purpose rooms" that serve double duty as a cafeteria and another purpose such as a recreation or exercise area. However, booths take up a lot of space and do not collapse easily with one another to facilitate their storage.

In light of the foregoing, booth seating which is collapsible, easy to maneuver, and easy to maintain is desired within the field.

SUMMARY OF THE INVENTION

One or more of the above-identified needs are met by providing booth seating having a collapsible seat portion wherein the seat portion is movable toward the seat back, and further having a rollable base. The booth may be placed in any public eating place or private kitchen without the disadvantages of poor mobility and difficult maintenance.

In accordance with a first aspect of the invention, a collapsible booth seating is provided having a vertically extending seat back having an interior frame and an optional exterior covering. A seat portion is located in front of the seat back and has an interior frame and exterior covering. The seat portion has a first seating surface and a second surface disposed opposite the first surface. A linkage arrangement is coupled to the seat portion and the seat back so as to permit the seat portion to move between a first, operative or deployed position where the first surface extends horizontally away from the seat back, and a second, folded or stowed position where the seat portion extends at an angle of no more than 45 degrees from vertical.

In one embodiment, the linkage arrangement has a pivot link with a first attachment to a front end of the seat portion, and a second attachment to a back end of the seat portion.

In one embodiment, the collapsible booth seating is supported below by a base, which supports at least one of the seat back and the seat portion off the ground. The base preferably has wheels thereunder.

In one embodiment, the collapsible booth seating has a seat leg that extends downward from the second surface of the seat portion. A linkage arrangement couples the seat leg to the seat portion to permit the seat leg to move between a first, supporting position in which the seat leg extends perpendicular to the second surface of the seat portion, and a second, stowed position in which the seat leg is substantially encompassed within the second surface.

In accordance with another aspect of the invention, a collapsible booth seating system comprises the collapsible booth seating having at least some of the characteristics described above, and a table that is spaced away from but adjacent to the seat portion when the seat portion is in an extended position.

In accordance with yet another aspect of the invention, a method of restaurant booth assembly is provided including the steps of positioning a collapsible booth seat in a desired location wherein the collapsible booth seat is as described herein, and moving the seat portion between the first, operative position to the second, folded position.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION PREFERRED EMBODIMENTS

A wide variety of booths could be constructed in accordance with the invention as defined by the claims. Hence, while the preferred embodiments of the invention will now be described with reference to a foldable mobile restaurant/cafeteria booth, it should be understood that the invention is in no way so limited.

Figure 1:
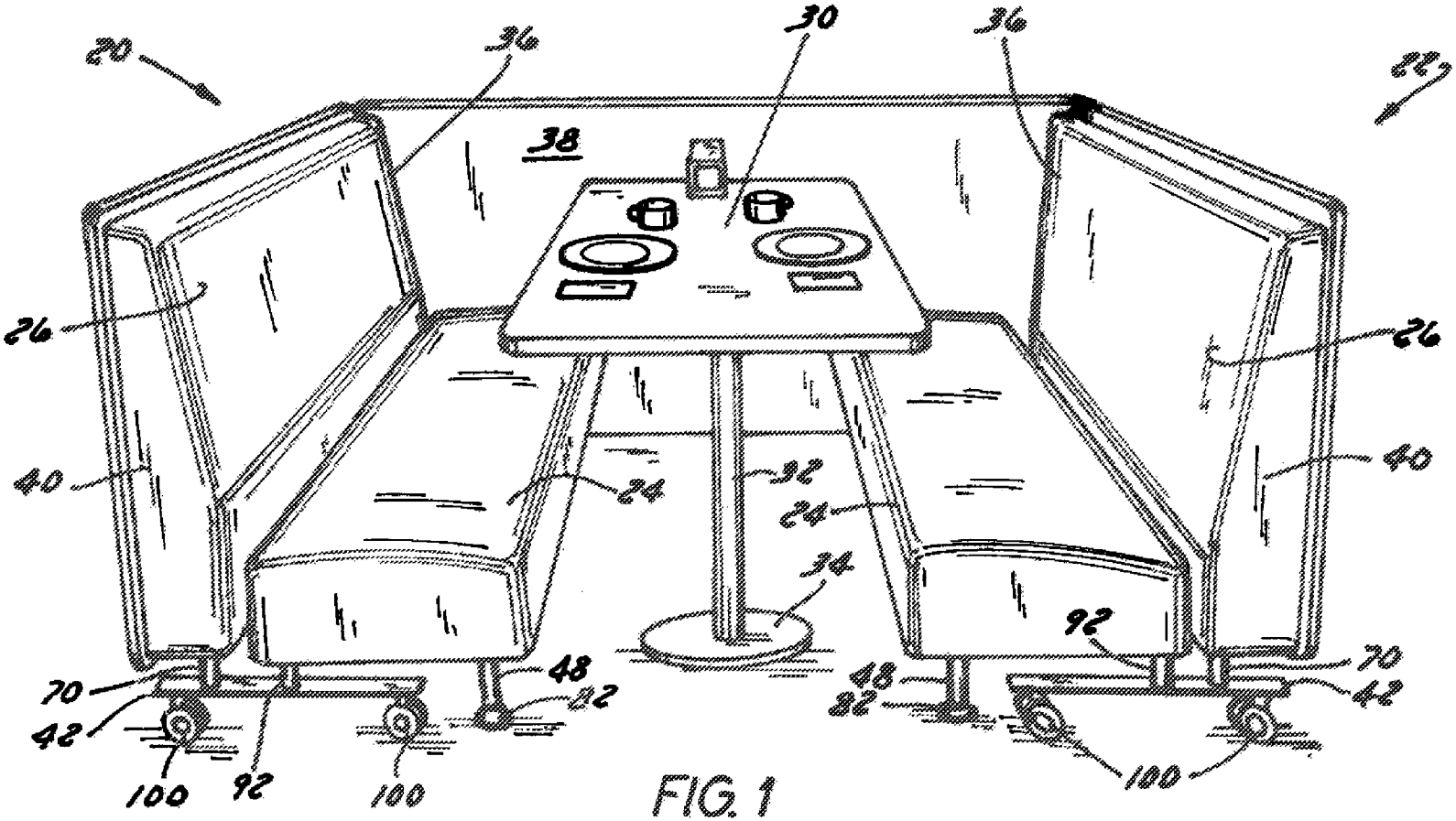
FIG. 1 is an isometric view of a foldable booth of a first embodiment of the present invention, showing the booth installed in a restaurant or cafeteria environment, and having the seat portion in a deployed position and the booth being used in connection with a table.

FIG. 1 illustrates a simplified perspective view of a foldable booth assembly 20 used in a restaurant or cafeteria environment in accordance with one embodiment of the invention. FIG. 1 shows a foldable booth assembly 20 used in conjunction with a second foldable booth assembly 22 so as to form an enclosed booth structure, as commonly found in restaurants to save space. Each foldable booth includes a seat 24 and a seat back 26 positioned behind the seat 24 and coupled to the seat 24 by a linkage 28 that permits the booth to fold as described below. The two foldable booth assemblies 20, 22 are positioned such that the seats are inward facing but are spaced apart so as to allow for a table 30 to be installed therebetween and allow for appropriate leg room for patrons sitting in the booth. The table 30 is generally installed between the two foldable booth assemblies 20, 22 as shown to allow for a common eating surface. While the table 30 is depicted as being supported by a vertically extending column 32 with a base 34 which sits on the ground, it is contemplated that the table 30 may alternatively be mounted to a wall or on moveable caster legs. One or both of the booth assemblies 22, 24 also could be deployed without a table, effectively serving as a bench.

A first end 36 of each of the foldable booth assemblies 20, 22 may be installed against a preexisting wall 38, whereas a second end 40 opposite the first end is freely exposed so that a restaurant patron may enter the booth structure at the exposed end to sit. It is appreciated that other booth structure arrangements may be performed with the foldable booth assembly 20, 22 as is commonly known in the art, and is not limited by the arrangement depicted here.

Figure 2:
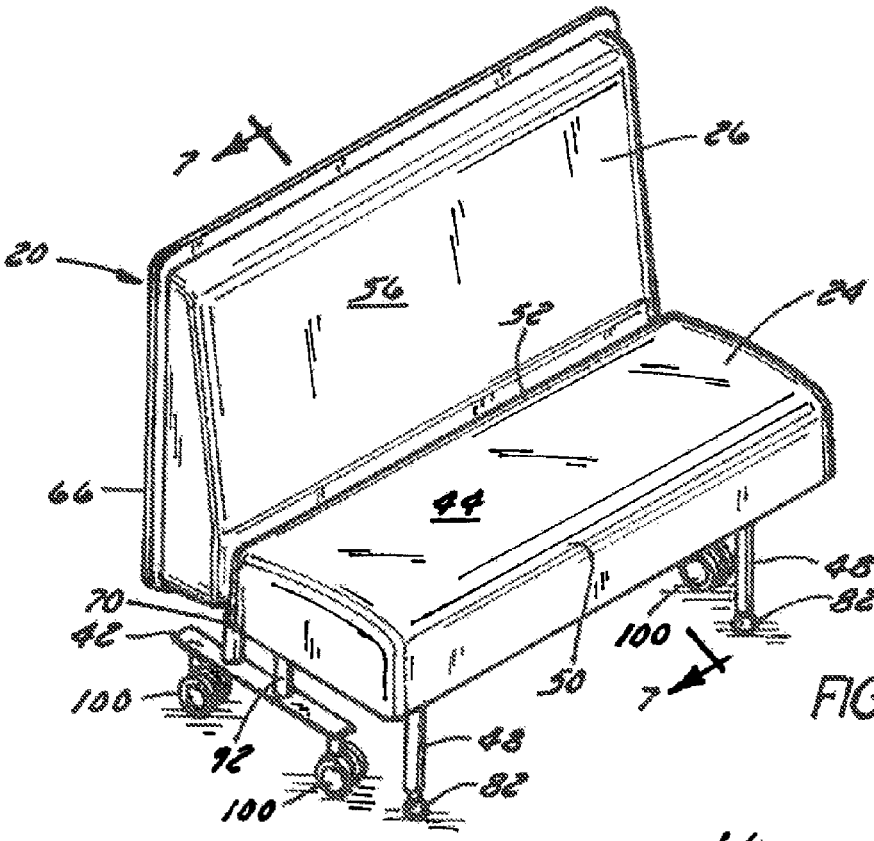
FIG. 2 is an isometric view of the foldable booth of FIG. 1, showing the seat portion in an operative position and the seat legs in a supporting position.
Figure 3:
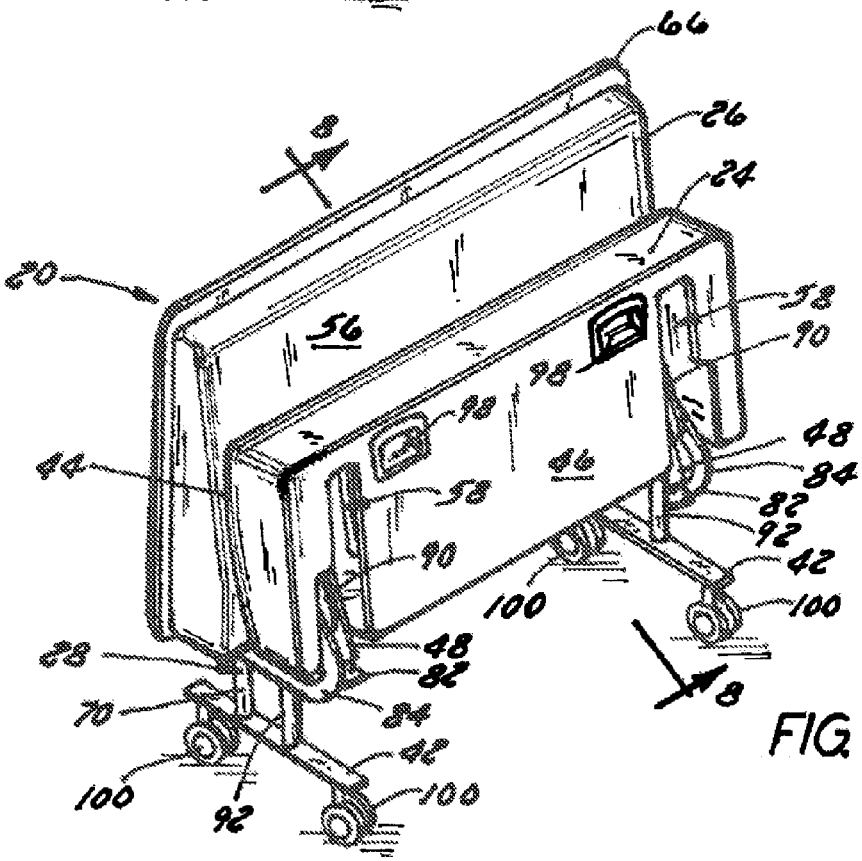
FIG. 3 is an isometric view of the foldable booth of FIGS. 1 and 2, showing the seat portion in a folded position and the seat legs in a stowed position.
Figure 4:
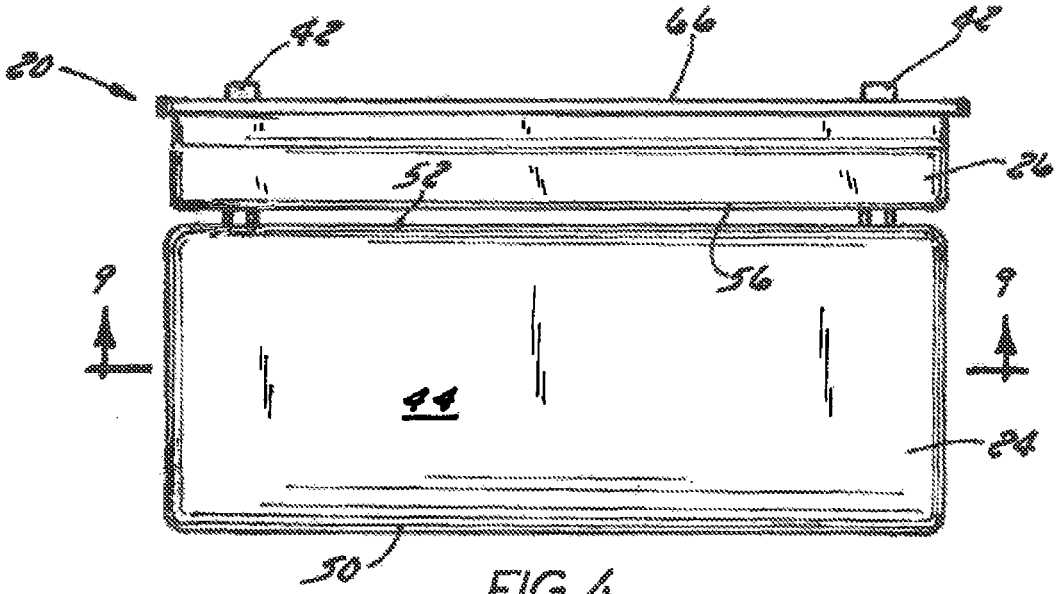
FIG. 4 is a top plan view of the foldable booth of FIGS. 1 and 2, showing the seat portion in an operative position and the seat legs in a supporting position.
Figure 5:
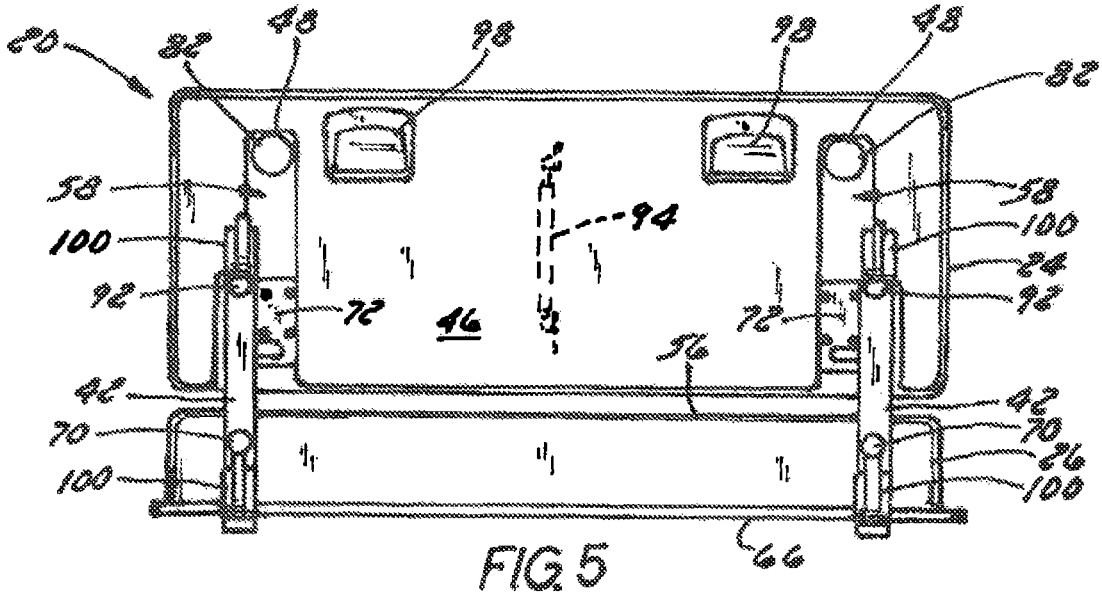
FIG. 5 is a bottom plan view of the foldable booth of FIGS. 1 and 2, showing the seat portion in an operative position and the seat legs in a supporting position.
Figure 6:
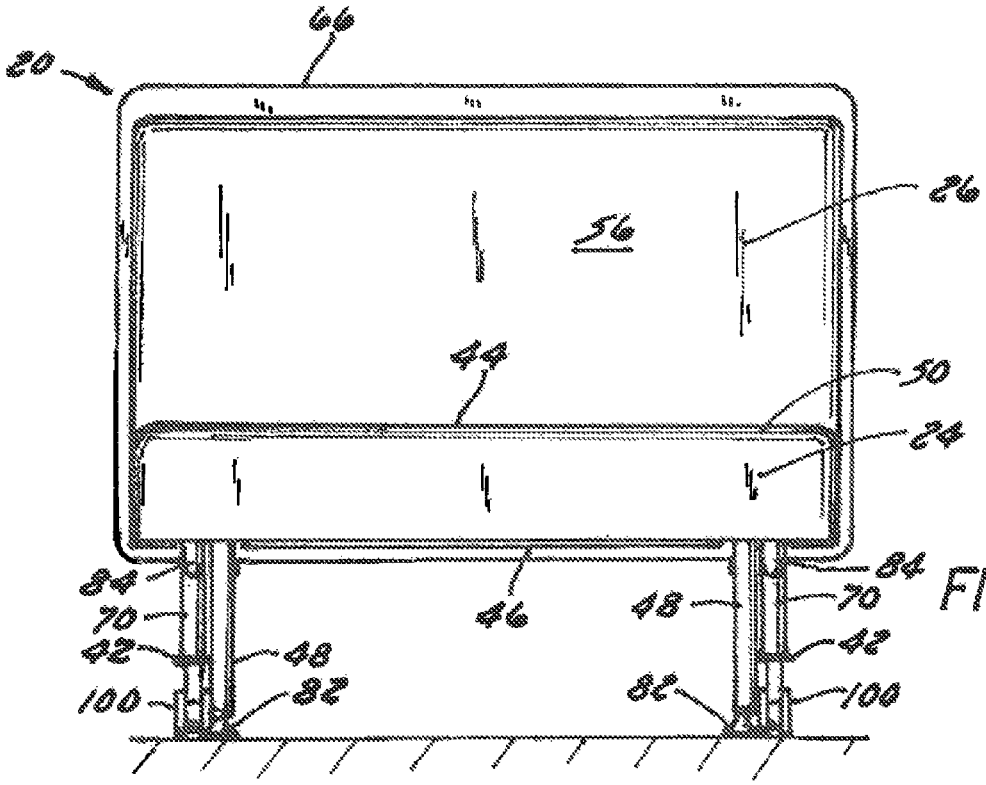
FIG. 6 is a front elevation view of the foldable booth of FIGS. 1 and 2, showing the seat portion in an operative position and the seat legs in a supporting position.
Figure 12:
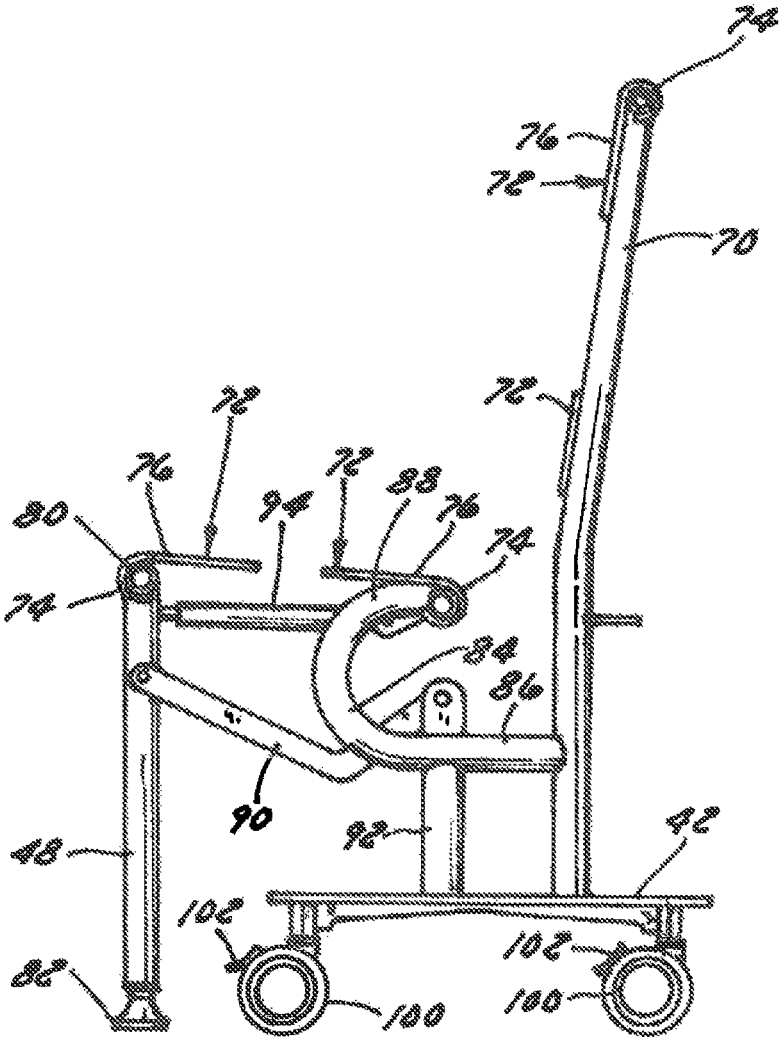
FIG. 12 is a side elevation view of the frame of FIG. 10.

FIGS. 2-3 illustrate two isometric views of one of the foldable booth assemblies 20, showing the foldable seat 24 in a first, operative position and a second, folded position, respectively. The foldable booth assembly 20 has a vertically extending seat back 26 and a foldable seat 24 supported below by a seat base 42 having wheels 100 thereunder. The wheels 100 could be eliminated, in which case the booth assembly 20 would be supported directly on legs. The vertically extending seat back 26 is generally stationary with respect to the seat base 42 and has a first, back-supporting surface 56 facing the seat 24 and a second surface 66 opposite the first surface 56. The back-supporting surface 56 may be shaped to support and provide comfort to a patron's back. The back-supporting surface 56 thus may be slightly angled or curved so as to match the spinal curvature of the user's body. The second surface 66 preferably is generally flat and may be, for example, positioned against a wall or partition against a second foldable booth assembly, or left exposed. The foldable seat 24 has a first, seating surface 44 and second surface 46 opposite the first surface such that the first seating surface 44 is upward facing and the second surface 46 is downward facing when the booth assembly 20 is in an operative position. Two seat bases 42 are provided near the opposed ends of the seat 24. Each seat base 42 underlies the seat back 26 and the rear end portion 52 of the seat 24 as best seen in FIG. 12. Each base 42 comprises a metal plate having sufficient strength and rigidity to support the remainder of the booth assembly 20. The seat base 42 may be supported on the ground by a plurality of wheels 100, such as caster wheels, which allow for improved mobility of the booth when in a folded position. However, when in the operative position, the wheels 100 may be locked by locks 102 (FIGS. 7 and 12) to prevent movement.

The seat back 26 and foldable seat 24 are independently coupled to the seat base 42 such that the weight carried by the seat back 26 and foldable seat 24 are distributed throughout and supported by the seat base 42 as described in more detail below. The folding action of the foldable seat 24 toward the seat back 26 is provided by a linkage arrangement 28 coupled to the foldable seat 24 and the seat back 26 as will be further described herein.

FIG. 2 shows the foldable booth assembly 20 in a first, operative position in which the first, seating surface 44 and second surface 46 of the foldable seat 24 are generally horizontal so that the user may sit on the seat 24. In the operative position, at least two support legs 48 of the booth may be extended at a front end 50 of the foldable seat 24 to provide additional support. A back end 52 of the foldable seat 24 and the seat back 26 remain generally supported by the seat base 42. The support legs 48 preferably are foldable as described in greater detail below.

FIG. 3 shows the foldable booth assembly 20 in a second, folded position in which the foldable seat 24 is moved toward the seat back 26 and in which the first seating surface 44 is generally adjacent to the back-supporting surface 56 of the seat back 26. The foldable seat 24 moves to at least 45 degrees from vertical, and preferably between 30 degrees and 15 degrees from vertical. In the folded position, the support legs 48 of the booth assembly 20 are stowed into recessed cavities 58 of the second surface 46 of the foldable seat 24. The second surface 46 may also have embedded handles 98 for facilitating handling of the booth. It is contemplated that the handles 98 may be provided as extending outward from the second surface 46 and not necessarily embedded therein. When in a folded position, the booth assembly 20 is now easy to maneuver on the (unlocked) wheeled base 42 and more compact form of the booth.

Figure 7:
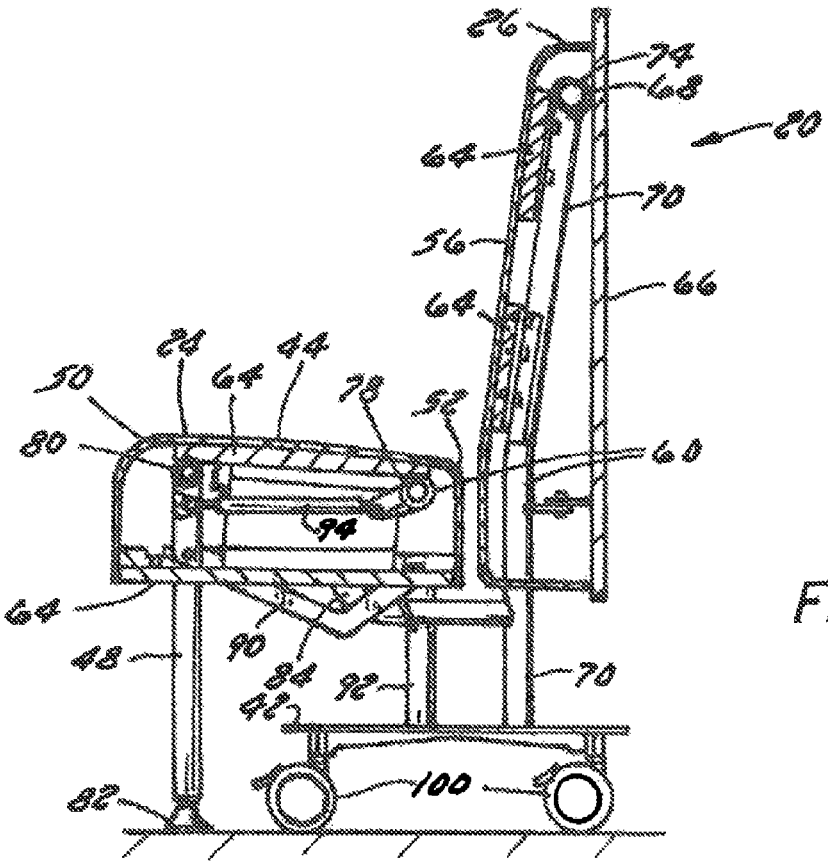
FIG. 7 is a side sectional view of the foldable booth of FIGS. 1 and 2 taken along line 7-7 in FIG. 2 with the seat in an operative position and the seat legs in a supporting position.

FIGS. 4-9 illustrate the particular features of the booth construction. Referring particularly to FIG. 7, both the seat 24 and the back have an interior frame 60 covered by a generally smooth exterior covering 62. The interior frame 60 may be steel tubing and mild steel plate attached thereon and forming the general interior framework of the booth assembly 20. The mild steel plate is preferably A36, steel and the steel tubing is preferably 1.25 inch diameter, 12 gauge steel.

A backing material 64 may be applied to the interior frame 60 to provide added rigidity. The backing material 64 may comprise, for example, PVC fiberboard or plywood. The backing material 64 may also be used to attach the exterior covering 62 to the interior frame 60. As seen, the backing material 64 is attached between the interior frame 60 and the covering 62 of the back supporting surface 56 and between the interior frame 60 and the covering of the first seating surface 44. It is contemplated that the backing material 64 may be used at other locations and positions on the interior frame 60, thereby connecting the exterior covering 62 and/or provided additional rigidity.

The exterior covering 62 of the foldable seat 24 may, for example, be a combination of reinforced fiberglass and reinforced fiberglass panels. The second surface 66 of the seat back 26 may be covered by a laminate covered wood panel with edge guarding for additional protection. The second surface 46 of the foldable seat 24 may also be covered by a wood panel covered in edge guarding material for additional protection.

In an alternative embodiment, the foldable booth assembly 20 is upholstered with cloth, leather, vinyl, etc. However, the interior frame 60 may have the same general construction as described above.

Figure 10:
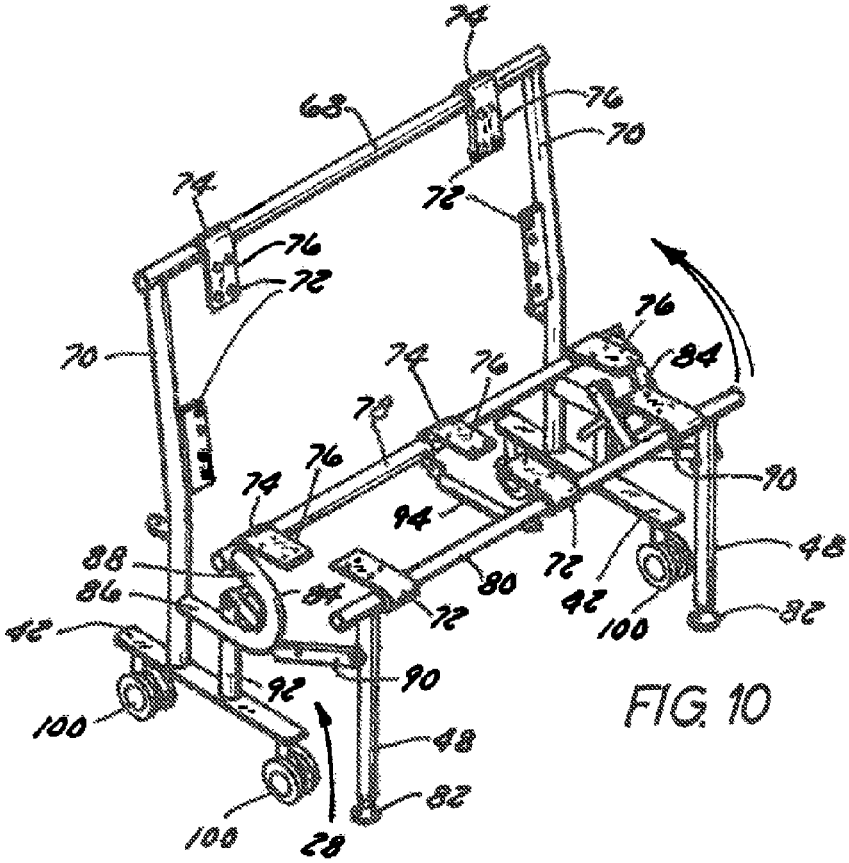
FIG. 10 is an isometric view of a frame of foldable booth of FIGS. 1 and 2, showing the remainder of the booth removed and the frame in its operative position.
Figure 11:
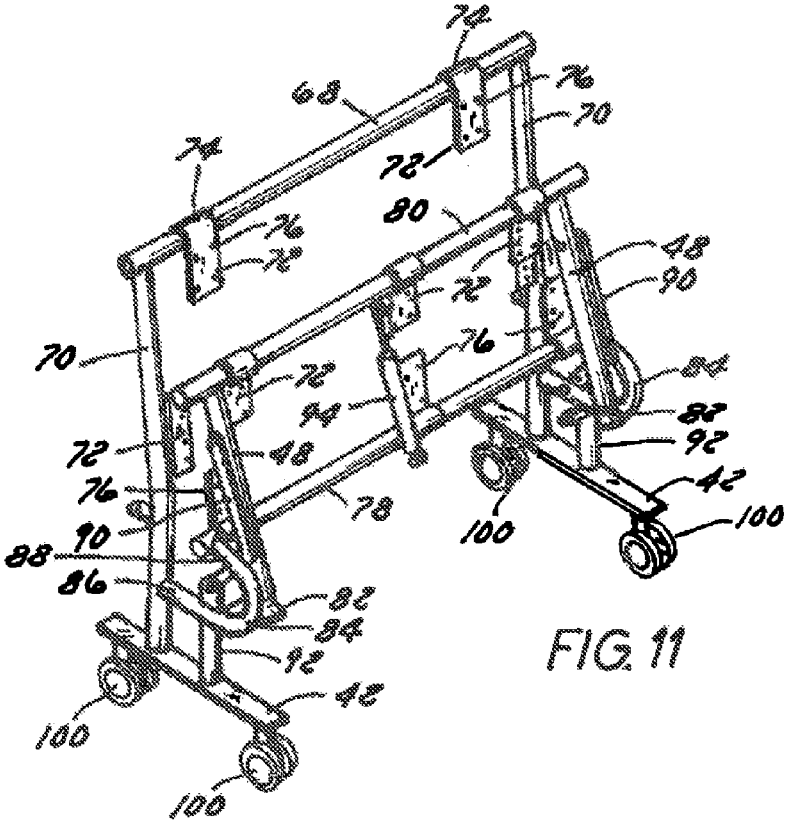
FIG. 11 is an isometric view of the frame of FIG. 10, showing the frame in its folded position.

FIGS. 10-12 illustrate the particular features of the booth assembly's 20 interior frame 60. As can be seen in FIGS. 10-11, the interior frame 60 conforms generally to the perimeter of the seat back 26, having a horizontally extending top tube 68 joined on its left and right ends by two generally vertically extending tubes 70 extending downward to the seat base 42. The lower ends of the tubes 70 are fixed to the respective seat bases 42. The tubes 70 have joint fittings 72 attached thereon for attachment to backing material 54 and/or exterior covering 62. Each joint fitting 72 includes a tubular sleeve 74 mounted over the respective tube and a plate 76 that extends tangentially from the sleeve 74 for receiving the backing material 54 and/or exterior covering 62. The sleeves 74 of the joint fittings 72 disposed within the seat 24 are rotatable about the tubes 78 and 80 on which they are mounted. Sleeve 74 rotation permits the backing material 54 and/or exterior covering 62 to swing about an are during seat 24 folding and unfolding. The interior frame 60 of the foldable seat 24 has a pair of horizontally extending tubes, a first defining a back tube 78 and a second defining a front tube 80, each coupled to the linkage arrangement 28, as will be further described herein. The back tube 78 and front tube 80 have joint fittings 72 attached thereon for similar attachment to backing material 54 and/or exterior covering 62.

The seat legs 48 are coupled to the respective opposite ends of the front tube 80 and extend vertically therefrom, forming perpendicularly to the front tube 80. The legs 48 are generally cylindrical tubes with bell caster inserts installed within the lower end of the tube, and a bell caster trumpet foot 82 fitted over the insert to provide ground support in a distributed manner. It is contemplated that other constructions of support legs and feet known in the art may be used. The upper end of each support leg 48 is fixed to the front tube 80, such as by welding.

As can be seen in FIGS. 10-12, the linkage system 28 connects the foldable seat 24 with the seat back 26 so as to permit pivoting movement therebetween. The linkage system 28 of this embodiment comprises a pair of generally U-shaped connectors 84 disposed at opposite side ends of the booth assembly 20 and connecting a lower end of the vertically extending tubes 70 of the seat back frame with the back tube 78 of the seat frame. Each vertically extending tube 70 is welded or otherwise affixed to a lower, long arm 86 of the U-shaped connector 84, and the back tube 78 is welded or otherwise affixed to an upper, short arm. 88 of the U-shaped connector 84 so that the back tube 78 is positioned in front of the vertically extending tubes 70.

The seat legs 48 and front tube 80 are pivotally coupled to the remainder of seat base 42 by a pair of V-shaped pivots links 90 disposed at opposite side ends of the booth assembly 20. Each pivot link 90 is pivotally coupled to an upper portion of the associated seat leg 48 at a first end, and is pivotally coupled to an upper end of a support 92 that projects upwardly from the seat base 42 at a second end.

As can be seen in FIGS. 10-11, folding of the foldable seat 24 occurs from pivoting of the pivot links 90 in the direction of the arrow in FIG. 10, causing the front tube 80 and legs 48 to swing through an arc inward toward the second surface 46 of the foldable seat 24.

A gas strut 94 or gas spring may be located between the front tube 80 and back tube 78 of the seat frame so as to reduce folding effort. The gas strut 94 may extend between the front tube 80 and back tube 78 near the mid-point of said tubes 80, 78 and have first and second ends pivotally connected to the front tube 80 and back tube 78, respectively. The gas strut 94 could be supplemented or replaced by one or more mechanical springs, if desired.

Figure 8:
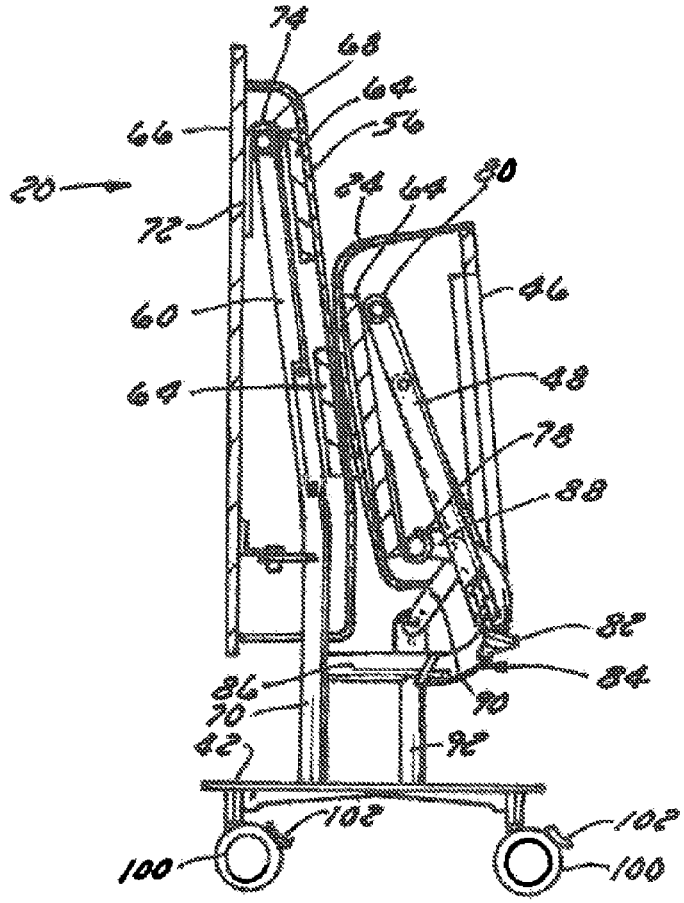
FIG. 8 is a side sectional view of the foldable booth taken along line 8-8 in FIG. 3 with the seat in a folded position and the seat legs are in a stowed position.
Figure 9:
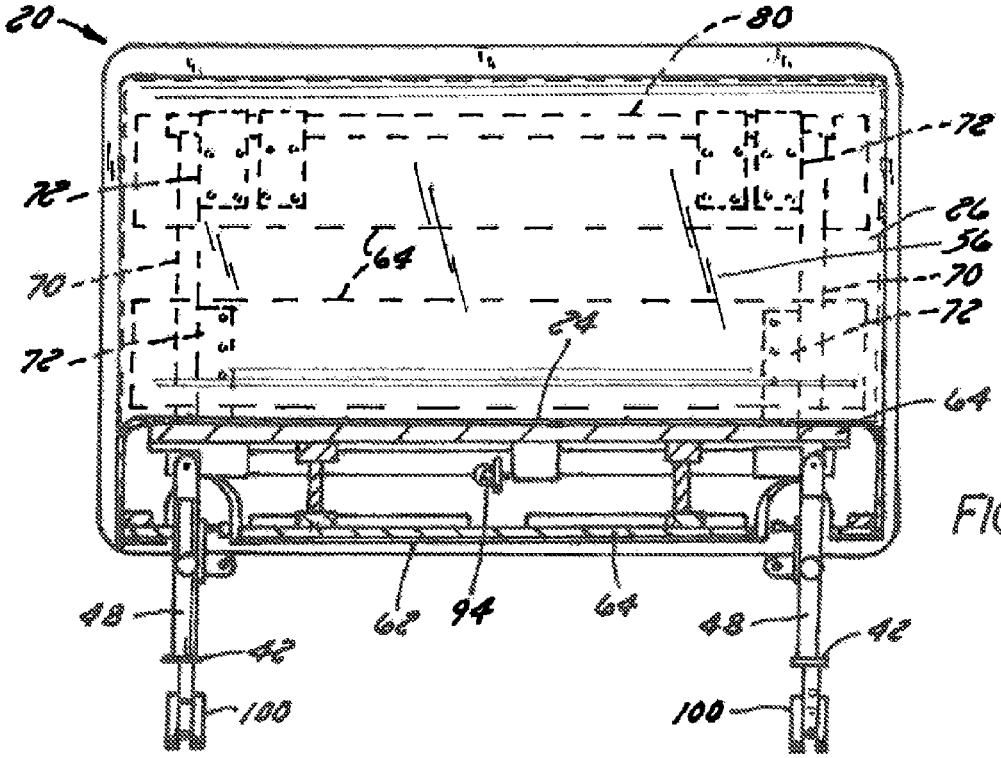
FIG. 9 is a front sectional view of the foldable booth taken along line 9-9 in FIG. 4.

In use, the foldable booth assembly 20 is transported to a desired location while in the folded position, as seen in FIGS. 3, 8 and 11. When in the folded position, the foldable seat 24 is generally adjacent to the back-supporting surface 56 of the seat back 26 and at least 45 degrees from vertical. The support legs 48 of the booth assembly 20 are stowed into the recessed cavities 58 of the second surface 46 of the foldable seat 24. The foldable booth assembly 20 is easy to transport and to store in a relatively small area in this more compact form.

According to the direction of the arrow in FIG. 10, once in the desired location, the booth assembly 20 is moved to the operative position. As seen by the resulting operative position in FIGS. 1-2, 4-7, 9-10, and 12, the first seating surface 44 and second surface 46 of the foldable seat 24 are moved at least 45 degrees, to a position which they are generally horizontal so that the user may sit on the seat 24. The movement is permitted by the pivoting rotation of the V-shaped pivot links 90 and the upper portion of the associated seat leg 48 at a first end, and the pivoting rotation of the V-shaped pivot links 90 and the upper end of support 92 at a second end. Sleeve 74 of each movable joint fitting 72 rotation permits the backing material 54 and/or exterior covering 62 to swing about an arc during seat folding and unfolding. The at least two support legs 48 of the booth assembly 20 are simultaneously pivoted by the movement of the foldable seat 24 to extend outward from the front end 50 of the foldable seat 24 to provide additional support.

When the user desires to store the booth assembly 20, the user will move the foldable seat 24 at least 45 degrees from horizontal toward the seat back 26, and the support legs 48 will simultaneously rotate into the recessed cavities 58 of the second surface 46, as described above as the folded position. In the folded position, the foldable booth assembly 20 can be easily transported to a storage location and stored in a collapsible state, either alone or with other foldable booth assemblies.

The seat swings over center when moving between its stowed and deployed positions, facilitating movement between the two positions and relying on gravity to help maintain it in the end position.

Figure 13:
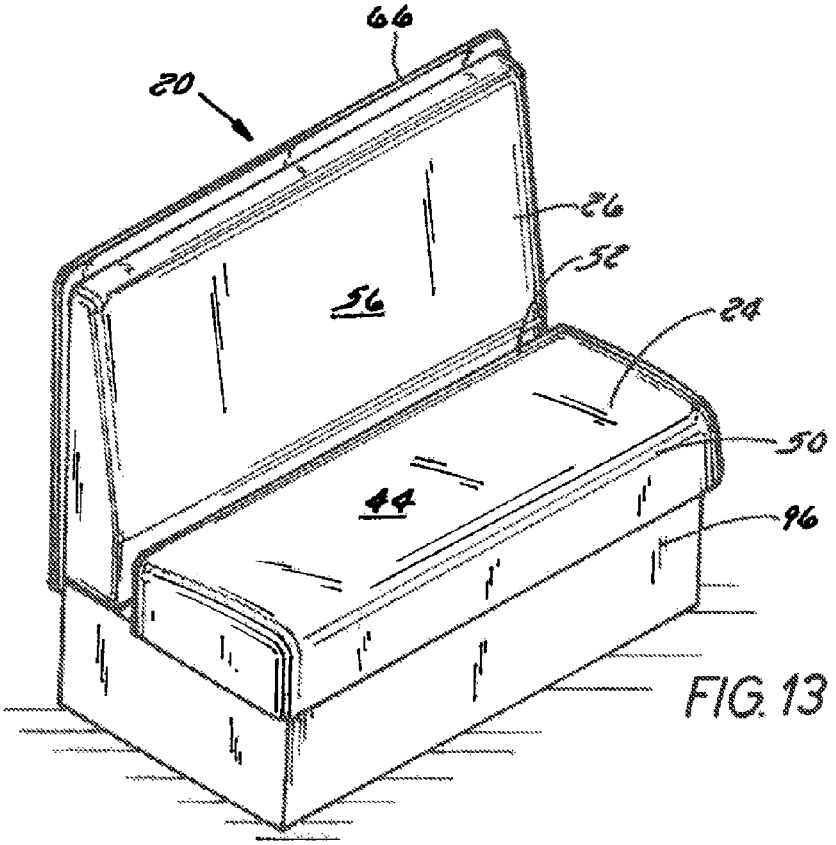
FIG. 13 is an isometric view of a foldable booth constructed in accordance with a second embodiment of the present invention, showing the booth within an enclosed base and the seat portion in an operative position.
Figure 14:
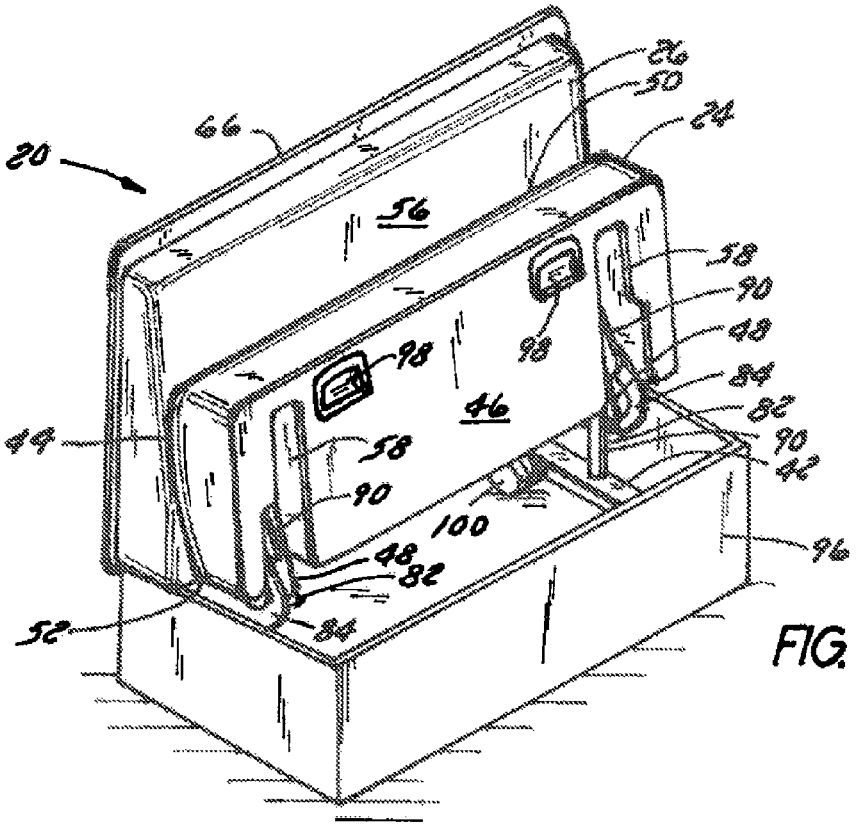
FIG. 14 is an isometric view of the foldable booth of FIG. 13, showing the seat portion in a folded position while within the enclosed base.

FIGS. 13-14 illustrate an alternative embodiment of the present invention. In the illustrated embodiment, the foldable booth assembly 20 is placed inside a covered enclosure 96 so as to provide a similar base appearance as is common in many restaurants. The booth base 42 is sized to fit within the covered enclosure 96. As seen in FIG. 14, the foldable seat 24 may still be folded upward to a folded position in accordance with the description provided herein.

Many changes and modifications could be made to the invention without departing from the spirit thereof. The scope of these changes and modifications will become apparent from the appended claims.

What we claim is:

1. A collapsible booth comprising:

a generally vertically extending seat back, wherein the seat back comprises an interior frame and an exterior covering;

a seat portion located in front of the seat back and having an interior frame and an exterior covering, the seat portion having a first seating surface and a second surface disposed generally opposite the first surface;

a linkage arrangement coupling the seat portion to the seat back so as to permit the seat portion to move from a first, operative position in which the first surface extends at least generally horizontally away from the seat back, to a second, folded position in which the seat portion extends at an angle of no more than 45 degrees from the seat back; and a seat leg extending downwardly from the second surface of the seat portion, wherein a linkage arrangement couples the seat leg to the seat portion so as to permit the seat leg to move from a first, supporting position in which the seat leg extends generally vertically to a second, stowed position in which the seat leg is at least substantially encompassed within the second surface of the seat portion.

2. The collapsible booth of claim 1, wherein the seat portion extends at an angle of no more than 30 degrees from vertical.

3. The collapsible booth of claim 1, wherein the seat portion extends at an angle of no more than 15 degrees from vertical.

4. The collapsible booth of claim 1, wherein the linkage arrangement comprises a pivot link with a first attachment to a front end of the seat portion and a second attachment to a back end of the seat portion.

5. The collapsible booth of claim 4, wherein the first and second attachments are pivot joints which allow at least 45 degree rotation of the seat portion toward the seat back from horizontal.

6. The collapsible booth of claim 1, further comprising a base disposed below and supporting at least one of the seat back and seat portion off a ground.

7. The collapsible booth of claim 6, wherein the base has wheels thereunder.

8. The collapsible booth of claim 6, wherein the seat back is stationary with respect to the base.

9. The collapsible booth of claim 1, wherein the linkage arrangement comprises a pivot link with a first attachment to the seat leg and a second attachment to a back end of the seat portion.

10. A collapsible booth seating system comprising:

a booth including:

a generally vertically extending seat back, wherein the seat back comprises an interior frame and an exterior covering, a seat portion located in front of the seat back and having an interior frame and an exterior covering, the seat portion having a first, seating surface and a second surface disposed generally opposite the first surface, a linkage arrangement coupling the seat portion to the seat back so as to permit the seat portion to move from a first, operative position in which the first surface extends at least generally horizontally away from the seat back, to a second, folded position in which the seat portion extends at an angle of no more than 45 degrees from the seat back, a seat leg extending downwardly from the second surface of the seat portion, wherein a linkage arrangement couples the seat leg to the seat portion so as to permit the seat leg to move from a first supporting position in which the seat leg extends generally vertically to a second, stowed position in which the seat leg is retracted toward the second surface of the seat portion, and wheels supporting the seat portion on the ground; and a table spaced away from and adjacent to the seat portion when the seat portion is in the operative position thereof, wherein the wheels permit movement of the booth along the ground independently of the table.

11. The collapsible booth seating system of claim 10, wherein the table is completely detached from a remainder of the booth seating system.

12. The collapsible restaurant booth seating system of claim 10, wherein the linkage arrangement comprises a pivot link with a first attachment to a front end of the seat portion and a second attachment to a back end of the seat portion.

13. The collapsible booth seating system of claim 10, wherein, when the seat leg is in the second, stowed position thereof, the seat leg is at least substantially encompassed within the second surface of the seat portion.

14. A method of restaurant booth assembly comprising the steps of:

positioning a collapsible booth seat in a desired location, wherein the collapsible booth seat comprises a generally vertically extending seat back, wherein the seat back comprises an interior frame and an exterior covering;

a seat portion located in front of the seat back and having an interior frame and an exterior covering, the seat portion having a first seating surface and a second surface disposed generally opposite the first surface;

a linkage arrangement coupling the seat portion to the seat back so as to permit the seat portion to move from a first, operative position in which the first surface extends at least generally horizontally away from the seat back, to a second, folded position in which the seat portion extends at an angle of no more than 45 degrees from the seat back;

a seat leg extending downwardly from the second surface of the seat portion, wherein a linkage arrangement couples the seat leg to the seat portion so as to permit the seat leg to move from a first, supporting position in which the seat leg extends generally vertically and supports the seat portion on the ground to a second, stowed position in which the seat leg is retracted toward the second surface of the seat portion; and moving the seat portion from the first, operative position to the second, folded position, causing the seat leg to move from its first, supporting position to its second, stowed position via operation of the linkage arrangement.

15. The method of claim 14, wherein the collapsible booth seating further comprises a rollable frame disposed below and supporting at least one of the seat back and seat portion off the ground, the rollable frame being supported on the ground via wheels.

16. The method of claim 15, further comprising the step of providing a table spaced and detached from the seat portion so that the collapsible booth is transportable independently of the table.

17. The method of claim 14, further comprising the step of placing the collapsible booth seat within a hollow base enclosure.

18. The method of claim 14, wherein, when the seat leg is in the second, stowed position thereof, the seat leg is at least substantially encompassed within the second surface of the seat portion.

* * * * *